United States Patent [19]

Hannebaum

[11] 4,273,096

[45] Jun. 16, 1981

[54] FIREPLACE

[76] Inventor: Harold Hannebaum, 420 E. Walnut St., P.O. Box #437, Bellevue, Id. 83313

[21] Appl. No.: 943,842

[22] Filed: Sep. 19, 1978

Related U.S. Application Data

[63] Continuation-in-part of Ser. No. 843,827, Oct. 20, 1977, Pat. No. 4,181,117, which is a continuation-in-part of Ser. No. 762,014, Jan. 24, 1977, abandoned.

[51] Int. Cl.[3] ..... F24B 1/18

[52] U.S. Cl. ..... 126/120; 126/77; 126/290; D23/97

[58] Field of Search ..... 126/120, 121, 140, 142, 126/135, 122, 123, 288, 289, 290, 63, 67, 77; D23/95, 96, 97

[56] References Cited

U.S. PATENT DOCUMENTS

| | | | |
|---|---|---|---|
| 2,400,900 | 5/1946 | Agricola | 126/77 |
| 2,470,430 | 5/1949 | Carter | 126/120 |
| 3,499,432 | 3/1970 | Hannebaum | 126/120 |
| 3,616,788 | 11/1971 | Hannebaum | 126/140 |
| 3,757,766 | 9/1973 | Stevenson | 126/60 |
| 4,108,144 | 8/1978 | Wilhoite | 126/120 |
| 4,112,913 | 9/1978 | Shimek et al. | 126/120 |
| 4,121,560 | 10/1978 | Knight | 126/121 |

FOREIGN PATENT DOCUMENTS

| | | | |
|---|---|---|---|
| 568197 | 3/1945 | United Kingdom | 126/142 |

*Primary Examiner*—Samuel Scott
*Assistant Examiner*—Lee E. Barrett
*Attorney, Agent, or Firm*—Howard I. Podell

[57] ABSTRACT

A fireplace heating unit provided with a firebox. A vertically elongated hollow member defining in horizontal cross section a square and formed primarily of transparent material, is open at both ends and is secured at its lower end to the firebox. A hollow top section having a relatively small open upper end which defines a chimney and a lower open and conforming to and engaging the upper end of said member has a narrow horizontal peripheral border having the same shape and essentially the perimeter as said square. Shaped openings partially blocked by louvers are formed in the border of the top and bottom section and hinged flaps are mounted outside of the louvers so as to control the amount of air passing into the heating unit through the louvers.

2 Claims, 13 Drawing Figures

FIG. 11

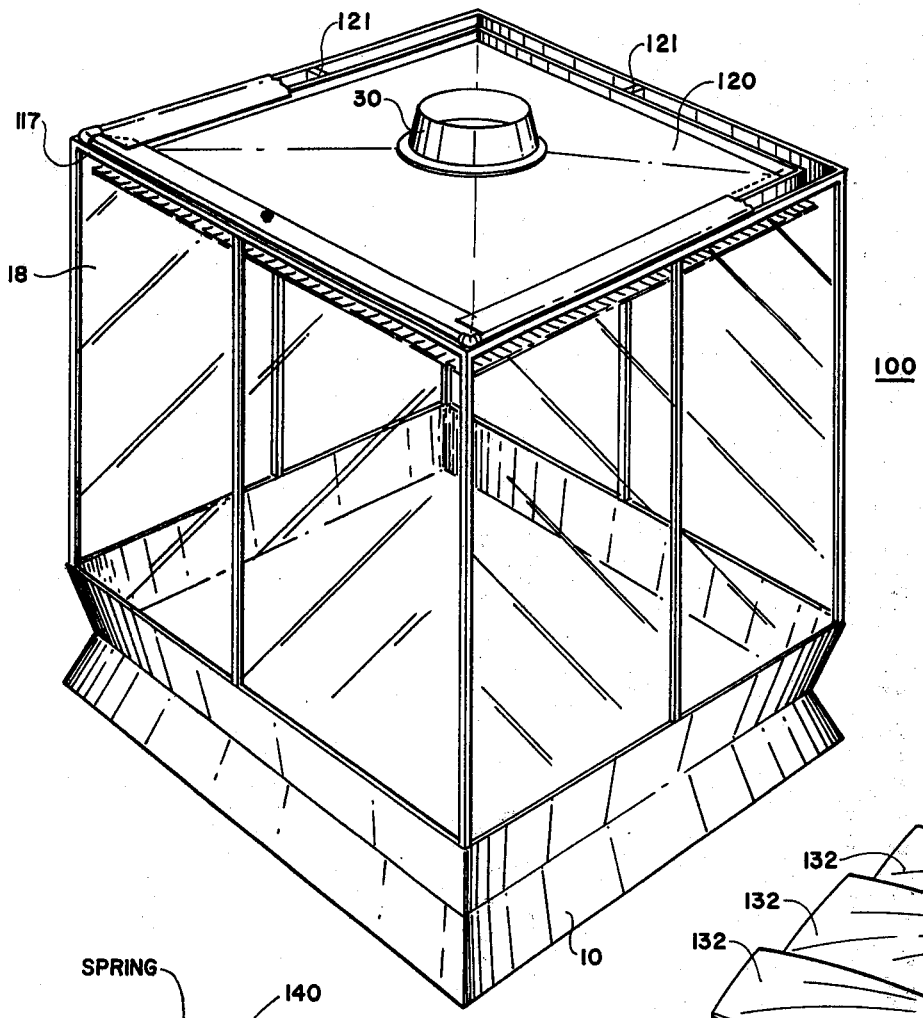
FIG. 6
FIG. 9
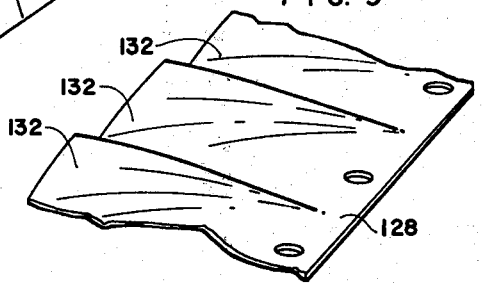
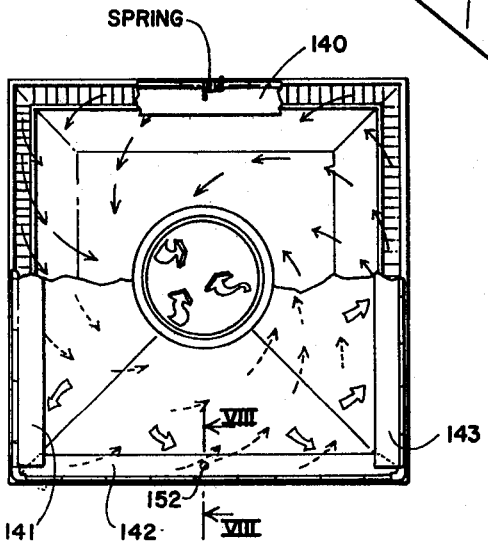
FIG. 7
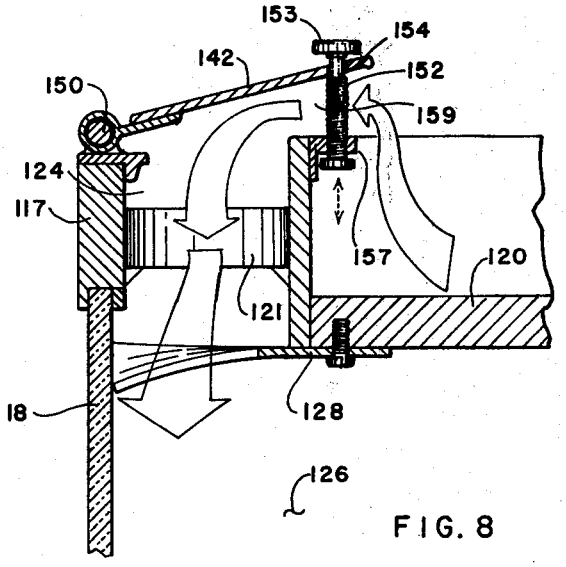
FIG. 8

FIREPLACE

This application is a continuation-in-part of co-pending application 843,827 filed on Oct. 20, 1977 entitled Fire Place which has issued as U.S. Pat. No. 4,181,117 on Jan. 1, 1980, which is a continuation-in-part of application Ser. No. 762,014 filed on Jan. 24, 1977, which application No. 762,014 is abandoned.

BACKGROUND OF THE INVENTION

On Mar. 10, 1970, applicant was awarded U.S. Pat. No. 3,499,432, entitled Heating Unit. This patent disclosed a wood burning fireplace employing a firebox supported on a vertical pedestal. A vertical hollow cylinder formed primarily of glass, open at upper and lower ends, and having at least one vertical air intake slot was secured at its lower end to the firebox and extended upward. A vertical hollow truncated cone open at both ends was secured at its bottom and larger end to the upper end of the cylinder and has a chimney or smokestack in its top and smaller end. When fuel is burned in the firebox, the air entering swirls upward in a generally helical pattern of ever decreasing diameter, providing an enhanced lighting effect and keeping the windows clear and free of smoke.

SUMMARY OF THE INVENTION

In accordance with the principles of this invention, a firebox is disposed in the bottom open end of a vertically elongated hollow member formed primarily of glass. The top open end of the member is disposed in the open bottom end of a hollow top section which extends upward to an open top end of a relatively small area which contains a chimney or smokestack. The bottom end of the top section is provided with a horizontal narrow border formed with individual shaped openings, or with a relatively continuous through slot communicating with the open top end of the member; this border having essentially the same perimeter as that of the hollow member. A similar border may be mounted in the bottom of the hollow member.

When fire is burned in the firebox, intake air swirls vertically away from the intake opening along the inner surfaces of the member, keeping the glass surfaces clean and clear. The air then swirls upward out of the chimney. The swirling action differs in appearance from that obtained by the use of the aforementioned patent but also produces an enhanced lighting effect. The flow of air through the border openings can be regulated as necessary by employing a fixed or manually adjustable louver in the border opening.

BRIEF DESCRIPTION OF THE DRAWINGS

In the accompanying drawing, in which is shown one of the various possible illustrative embodiments of this invention, wherein like reference character identify the same or like parts:

FIG. 6 is a perspective view of a second alternative embodiment of the invention;

FIG. 7 is a plan view of the second embodiment;

FIG. 8 is a detail sectional view taken along line 8—8 of FIG. 7;

FIG. 9 is a detail perspective view of a louver plate;

DETAILED DESCRIPTION OF PREFERRED EMBODIMENT

Figure 1:
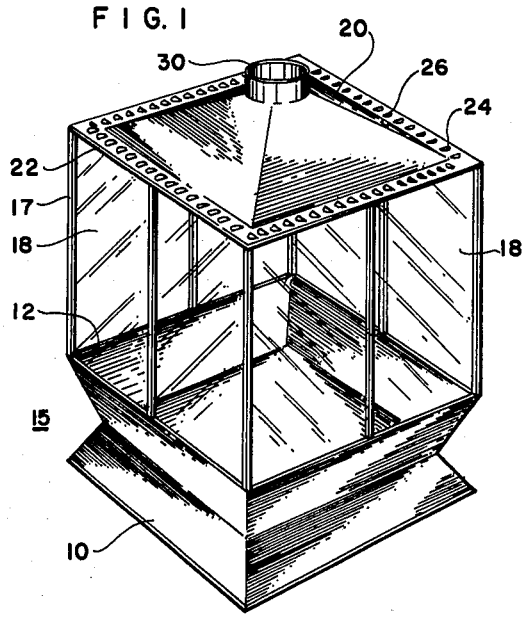
FIG. 1 is a perspective view of the invention.
Figure 2:
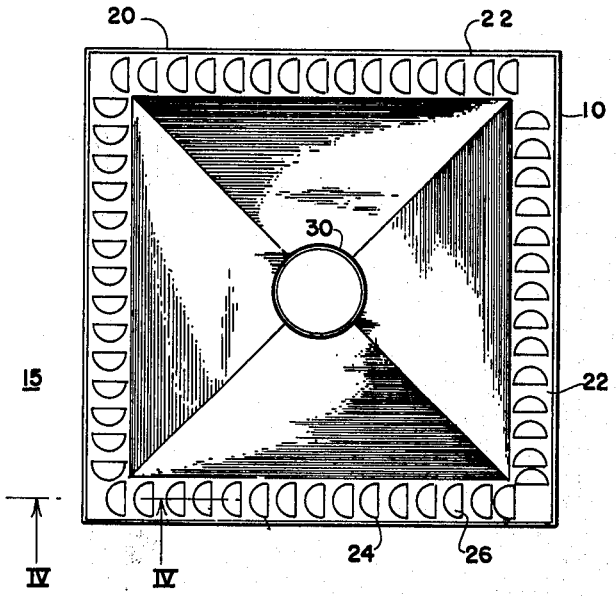
FIG. 2 is a top view thereof.
Figure 4:
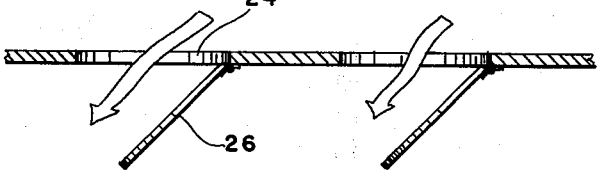
FIG. 4 is a detail view taken along line IV—IV in FIG. 1.
Figure 3:
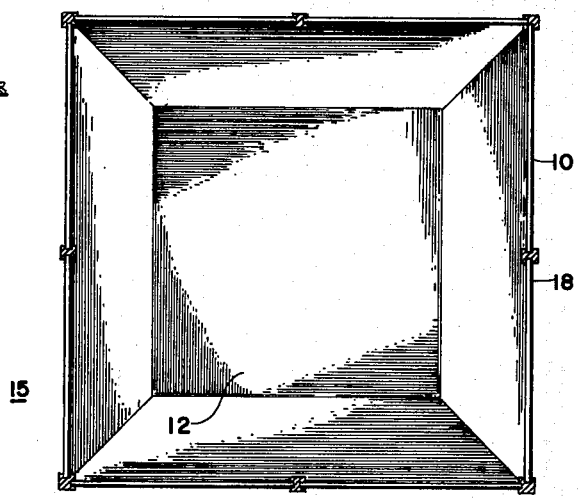
FIG. 3 is a bottom view thereof.

Referring now to FIGS. 1–4, fireplace 15 rests on a pedestal 10 which supports a firebox 12 having a square shaped periphery. A vertical hollow body or member open at both ends takes the form of a frame 17 containing vertical panes of glass 18. The member in horizontal cross section defines a square with one or two panes per side.

A hollow metal hood identified generally at 20 has an open bottom square shaped end 22 which rests upon and extends over the sides of the upper end of the frame. The hood tapers upward and inward to a vertical pipe, chimney or smokestack 30 which is open and has a cross sectional area which is small with respect to that of the bottom end of the hood.

Bottom end of hood 20 is formed as a flat square-shaped flange border 22, overlying the inner surfaces of the corresponding sides of the glass panes. Shaped openings in border 22 may be each partially blocked by a fixed or adjustable louver 26 internally mounted to border 22 within the interior of the frame 17, to control air flow into the interior through openings 24.

Louvers 26 are each in the form of a flat vane and each oriented with respect to an opening 24 so that when fuel is burned in the firebox, intake air flows or swirls downwardly through the opening 24 and along the inner surfaces of the glass, keeping these surfaces clear and clean. The heated air then swirls upwardly and out the chimney as previously described.

Figure 5:
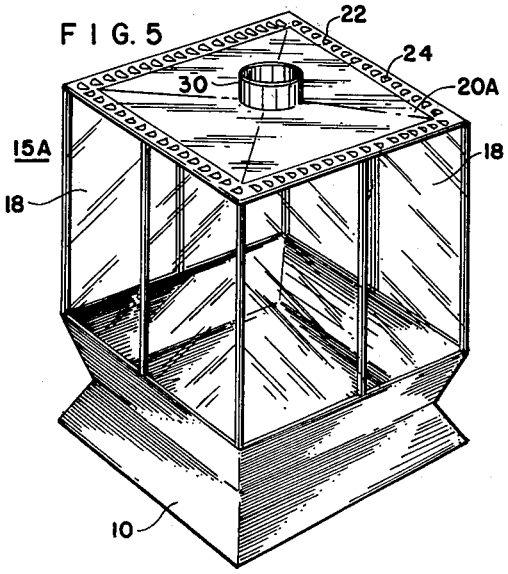
FIG. 5 is a perspective view of a first alternative embodiment of the invention.
Figure 11:
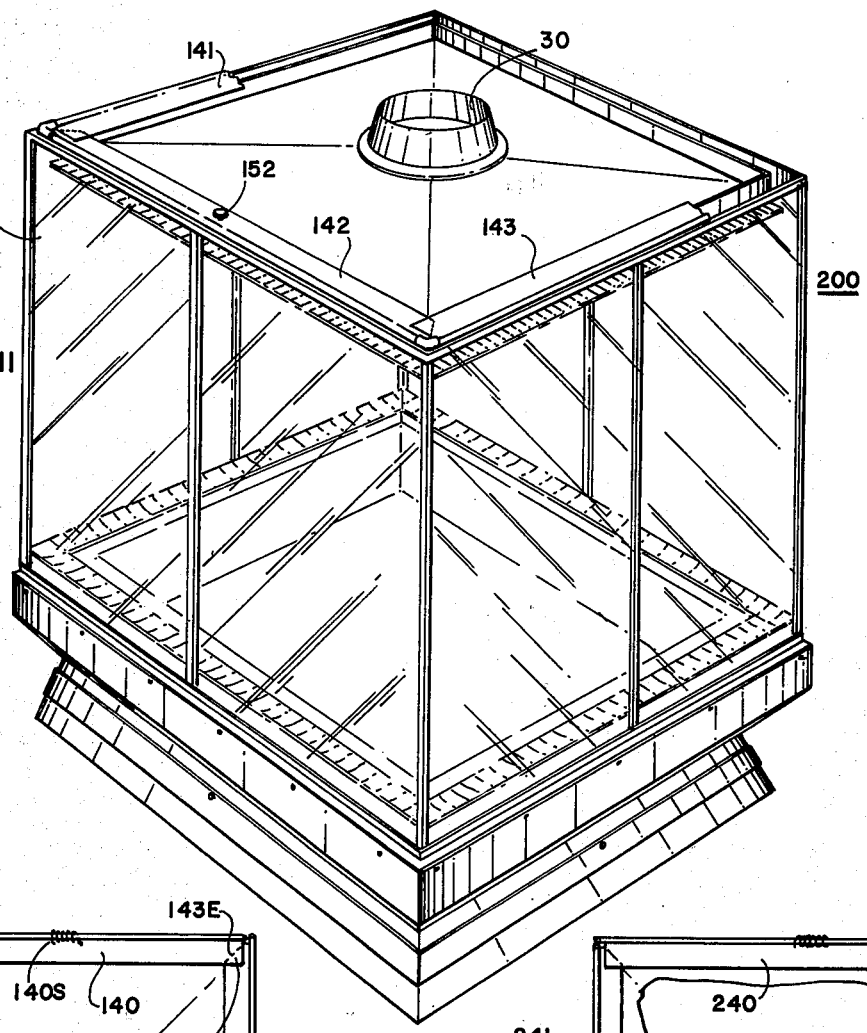
FIG. 11 is a perspective view of a third alternative embodiment of the invention.

The cross sectional shape of the member can be square, round, oval, pentagon, hexagon or octagon and the same results can be obtained. As shown in FIG. 5, an alternative embodiment 15A of similar construction may be formed with a flat horizontal hood 20A substituted for the tapered hood 20 of the fireplace 15.

FIGS. 6–10 illustrate a second alternative embodiment, fireplace 100 of similar construction to fireplace 15A except as noted hereinafter.

Hood 120 of fireplace 15A is spaced a uniform distance from the frame 117 on each side by spaced brackets 121 to form an open through peripheral intake slot 124 through which air can pass into the interior 126 of the fireplace on all four sides of hood 120.

The bottom of each groove 124 is partially blocked by a continuous vane strip 128 bolted to the bottom of hood 120, with vane strip 128 shaped to form a plurality of finger louver sections 132 each extending below the slot 124 and each similarly bent so as to deflect the vertical flow of intake air into a horizontal clockwise flow as seen from above.

Figure 10:
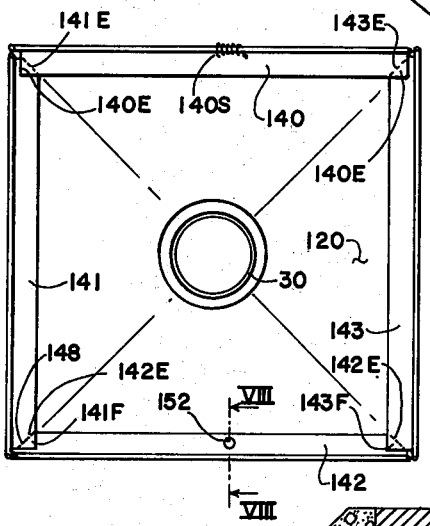
FIG. 10 is a plan view of the top of the second embodiment.
Figure 13:
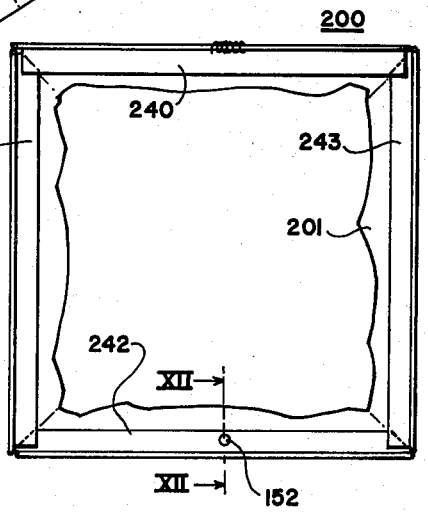
FIG. 13 is a bottom plan view of the border section of the third alternative embodiment.
Figure 12:
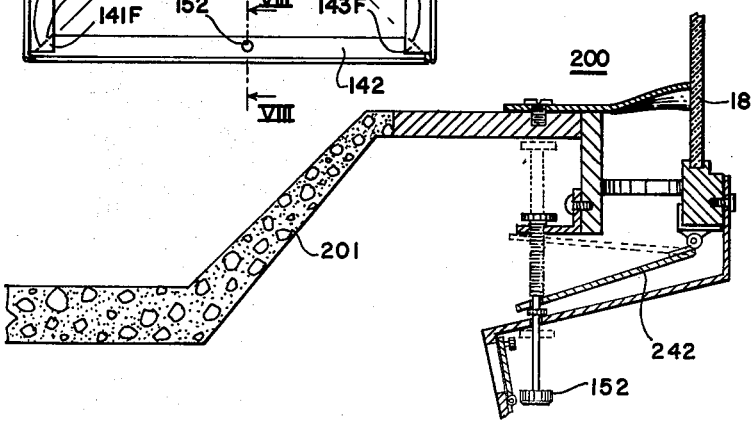
FIG. 12 is a detail sectional view of the third embodiment taken along line 12—12 of FIG. 13.

A cover 140–143 extends externally along the top of each slot 124 of a size to completely block each slot, with each cover joined by a piano hinge 150 to the top of the frame 17. The covers overlap each other at their respective ends with the ends 140E cover 140 overlapping the ends 141E, 143E of covers 141 and 143, and the opposed ends 141F, 143F overlapping the respective ends 142E of cover 142 as shown in FIG. 10 so that closing of cover 140 as caused by the spring bias of a hinge spring 140S causes all the covers to close, while opening of cover 142 as caused by bearing pressure of adjustment screw 152 causes all covers to open.

To enable the covers to coast together, the overlapping end sections 140E, 141F, 143F of all covers are of a rectangular corner shape, while the end sections 141E, 143E and 142E of cover sections that are overlapped are shaped with a diagonal edge 148 on a convex arcuate shaped edge that extends in the closed position on the cover from the hinge axis of the cover towards the center of the hood 120.

Adjustment screw 152 is threaded through a bracket 157 externally fixed to hood 120 and freely extends through a hole in cover 142 with the head section 153 joined to an undercut stem section 154 that freely fits in the said cover hole, and with the threaded section of screw 152 of a greater pitch diameter than the cover hole so that the cover rides between the head and the threaded section of screw 152 as screw 152 is rotated to increase or decrease the distance of screw head 153 and the cover 142 above the bracket 157 so as to vary the opening 159 between the covers 140–143 and the top edge of the hood 120 to regulate the air flow through all intake slots 124.

FIGS. 10–13 illustrate similar covers 240–243 and peripheral louver intake mounted along the bottom section of a fireplace 200 about the periphery of the firebox 201.

While the invention has been described with particular reference to the drawings, the protection sought to be limited only by the terms which follow.

Having thus described the invention, what I claim as new and desired to secure by Letters Patent of the United States is:

1. A heating unit comprising:

a firebox;

a vertically elongated hollow member formed primarily of transparent material, said member being open at both ends and secured at its lower end to the firebox; and a hollow top section having a relatively small open end conforming to and engaging the upper end of said hollow member, said top section having a narrow horizontal peripheral border formed with at least one opening communicating with the interior of the hollow member, said border having essentially the same perimeter as that of said member, wherein said border has a louver mounted to said border located so as to direct the flow of air through the border opening, wherein said opening and said louver are located in said border in a position so that a fire in the firebox causes air to be drawn into the interior of the hollow member, when the forebox is in use, with said louver oriented so as to direct said drawn air intitially along a vertically down extending path in the fire, with the exhaust gases in the forebox being then discharged upwardly through said chimney, in which a hinged cover unit is pivotally mounted externally to the top section and located to block the opening of the border in the closed position of the cover, together with spring means to bias the cover to the closed position and screw means to pivot the cover away from the closed position so as to regulate the size of opening leading into the interior of the hollow member, in which the border is formed with a plurality of sets of openings with a separate cover pivotally mounted externally of each set of openings, and with the said covers in frictional engagement with each other so that a single spring means biases all covers to the closed position and a single screw means serves to adjust all the covers away from the closed position.

2. The combination as recited in claim 1, in which the heating unit is also fitted with a plurality of sets of openings in a border of the bottom section of the frame located between the firebox and the transparent material of the hollow member, with a separate cover pivotally mounted externally of each set of openings, and with the covers in frictional engagement with each other so that a single spring means biases all covers to the closed position and a single screw means serves to adjust all the covers away from the closed position.

* * * * *